United States Patent [19]

Rose

[11] Patent Number: 5,056,271

[45] Date of Patent: Oct. 15, 1991

[54] METHOD FOR CLEANING PIPE

[75] Inventor: James L. Rose, Houston, Tex.

[73] Assignee: E. B. Thomas, Houston, Tex.

[21] Appl. No.: 636,673

[22] Filed: Jan. 2, 1991

Related U.S. Application Data

[62] Division of Ser. No. 470,819, Jan. 26, 1990, abandoned.

[51] Int. Cl.[5] ..... B24C 3/06

[52] U.S. Cl. ..... 51/319; 51/429

[58] Field of Search ..... 51/410, 411, 429, 432, 51/420, 424, 425, 426, 319, 320, 321, 317

[56] References Cited

U.S. PATENT DOCUMENTS

| | | | |
|---|---|---|---|
| 1,611,920 | 12/1926 | Kinzbach . | |
| 1,815,573 | 7/1931 | McManis . | |
| 1,910,497 | 5/1933 | Peix . | |
| 1,926,387 | 9/1933 | Jansen . | |
| 2,621,446 | 12/1952 | Russell . | |
| 3,362,109 | 1/1968 | Wallace . | |
| 4,205,694 | 6/1980 | Thompson et al. . | |
| 4,603,516 | 8/1986 | Hoffman | 51/429 |
| 4,677,936 | 7/1987 | Dehlm | 51/429 |
| 4,953,496 | 9/1990 | Taylor et al. | 51/429 |

FOREIGN PATENT DOCUMENTS 0232770 12/1984 Japan ..... 51/429

OTHER PUBLICATIONS

European Publication No. 0343878 published Nov. 29, 1989.

*Primary Examiner*—James G. Smith
*Assistant Examiner*—Blynn Shideler
*Attorney, Agent, or Firm*—Dodge, Bush, Moseley & Riddle

[57] ABSTRACT

A self propelled carriage (28) has a housing (30) comprised of a center body section (51) and a pair of side sections (52) hinged (54) to the body section (51). Side sections (52) may be swung to an open "clamshell" like position for lowering of the carriage (28) onto the pipe (10) for travel along the pipe (10). Nozzle (72) for the discharge of abrasive particles, such as sand, are mounted for oscillating movement in a predetermined stroke to cover a predetermined outer surface area of the pipe (10) for cleaning the pipe and for providing a rough finish for the application of a coating.

6 Claims, 4 Drawing Sheets

FIG. 6
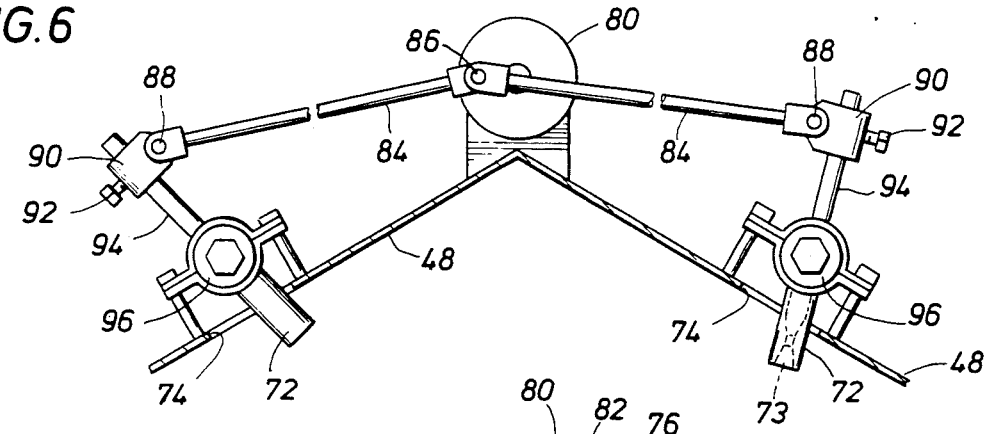
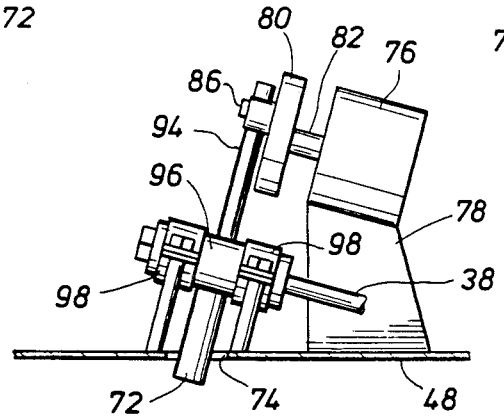
FIG. 7
FIG. 8
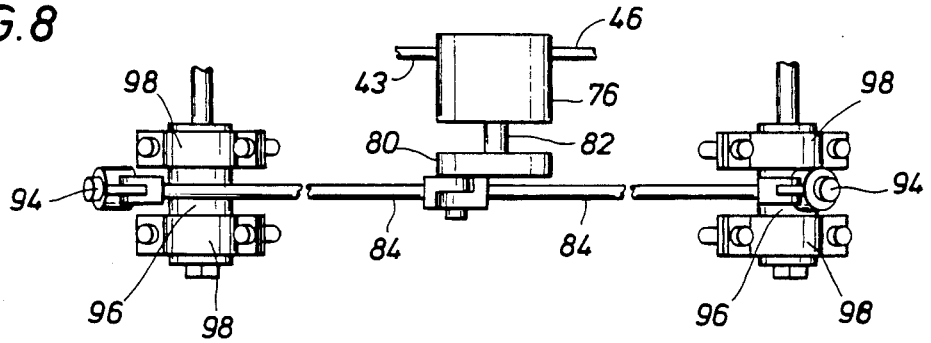
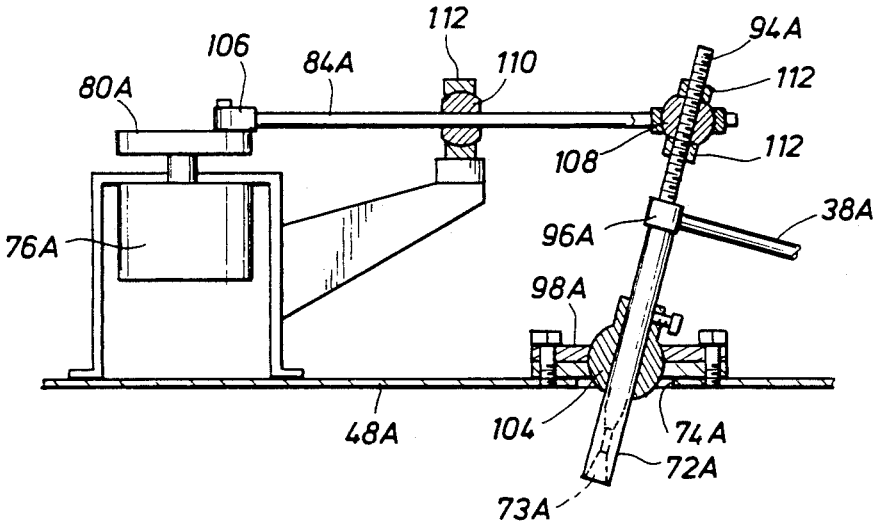
FIG. 9

METHOD FOR CLEANING PIPE

CROSS REFERENCE TO RELATED APPLICATION

This application is a division of pending application Ser. No. 470,819 filed Jan. 26, 1990 now abandoned.

BACKGROUND OF THE INVENTION

This invention relates to the method and apparatus for cleaning pipe, and more particularly to such a method and apparatus for cleaning the outside of the pipe as the apparatus moves along the pipe.

Heretofore, self propelled apparatus has been provided, such as shown in U.S. Pat. No. 4,603,516 for cleaning the outside of pipe as the apparatus moves along the pipe while supported thereon. Cleaning the outside of pipe removes loose rust, scale and dirt, to prepare the pipe for the subsequent application of a coating material on the outer surface of the pipe to minimize corrosion and prolong the service life of the pipe. In some instances, the pipe may be wrapped with an outer lining material containing an inner coating material for contacting the outer cleaned surface of the pipe. Normally abrasive particles, such as hard shot particles or grit, has been thrown by centrifugal force from an impeller wheel or the like against the outside of the pipe for cleaning the pipe. Particularly where hard shot particles of a uniform size were used previously, a relatively smooth clean outer surface of pipe was provided.

It is desirable to have a roughness on the outer surface of the pipe to provide a strong bond between the pipe and coating. The roughness increases the surface area of the pipe in contact with the coating for "anchoring" the coating on the pipe. Such an increased area bond is particularly needed upon an expansion of the pipe resulting from pressure or temperature increases to maintain the bonding contact between the pipe and coating. The greater the roughness, the stronger the bond between the pipe and coating particularly for shearing stresses.

A blast chamber on a self propelled carriage travelling along the pipe has been utilized previously but such carriages have been relatively complex for carrying blast wheels or impellers and for assembly on and disassembly off the pipe.

SUMMARY OF THE INVENTION

The present invention is directed to a self propelled housing or carriage adapted to be easily assembled onto a pipe for movement therealong. The carriage includes an upper center body section supported on the upper surface of the pipe and two opposed side sections hinged to the upper section for outward swinging or pivotal movement in an open position for lowering onto the pipe. Upon contact of the center body section with the pipe the two side sections are pivoted downwardly about the pipe and latched with the upper section of the carriage supported on the pipe for self propelled movement along the pipe.

The self propelled carriage may be easily removed from the pipe by unlatching the two side sections and swinging the side sections to an open position removed from the pipe. Then, the carriage may be lifted by the center body section for removal from the pipe.

In order to provide adequate bonding between the coating and the outer surface of the cleaned pipe to which the coating is applied, it is desirable to have a predetermined roughness on the outer surface. The desired roughness may vary dependent on such factors, for example, as the type of coating, the thickness of the coating, the size and operating parameters for the pipe, and the material from which the pipe is made. Roughness is obtained by surface irregularities and normally measured in mils (1/1000 inch) based on the projected height of the irregularities from the base surface. A roughness between around one (1) mil and four (4) mils is normally obtained as measured in accord with a root means square (RMS) of the irregularities. A predetermined roughness may be provided by the present invention from around ½ mil to six (6) mils and the apparatus is adapted for use on all pipe diameters but might not be practical for small pipe sizes such as pipe under ten (10) inches in diameter for example.

The apparatus and method of the present invention are particularly adapted for use with grit, such as sand, having an irregular non-uniform size in order to provide the desired roughness. The grit is discharged from nozzles mounted on the carriage and spaced about the outer circumference of the pipe. The nozzles are mounted on the carriage for oscillating movement so that each nozzle may cover a predetermined defined area or circumferential portion of the pipe for cleaning. The arcuate portion covered by each nozzle may be adjusted by the stroke of the nozzles as desired to provide overlapping patterns with adjacent nozzles and to adapt for pipes having different diameters. The grit is entrained in pressurized air for discharge from the nozzles. After striking the pipe, the grit falls to the bottom of the enclosed housing forming the carriage and is returned to a trailer or skid pulled alongside the pipe for cleaning and storage for another cycle. The trailer or skid also carries a source of air and hydraulic fluid for operation of the cleaning apparatus.

It is an object of the present invention to provide a method and apparatus for cleaning the outside of pipe including a self propelled carriage moving along the pipe and discharging abrasive particles against the pipe to clean the pipe and provide a predetermined rough finish on the pipe for subsequent coating.

It is a further object of this invention to provide such an apparatus and method in which side sections of the carriage may be easily swung to an open "clamshell" like position for initial positioning on the pipe and for subsequent removal from the pipe.

An additional object of the invention to is provide such an apparatus and method in which a plurality of nozzles are mounted on the carriage for oscillation in a predetermined stroke and ar space about the circumference of the pipe for the discharge of air and entrained abrasive particles against the pipe.

Other objects, features, and advantages of this invention will become more apparent after referring to the following specification and drawings.

BRIEF DESCRIPTION OF THE DRAWINGS

FIG. 6 is an enlarged end view of a portion of the carriage housing showing a pair of discharge nozzles mounted thereon for oscillation;

FIG. 7 is an enlarged side elevation of a nozzle shown in FIG. 6 and illustrating the means mounting the nozzle for oscillating movement;

FIG. 8 is a plan of the discharge nozzles and drive means therefor shown in FIGS. 6 and 7; and FIG. 9 is an elevational view, partly in section, of another nozzle embodiment in which the nozzle is mounted for oscillation in a generally circular path.

DESCRIPTION OF THE INVENTION

Figure 1:
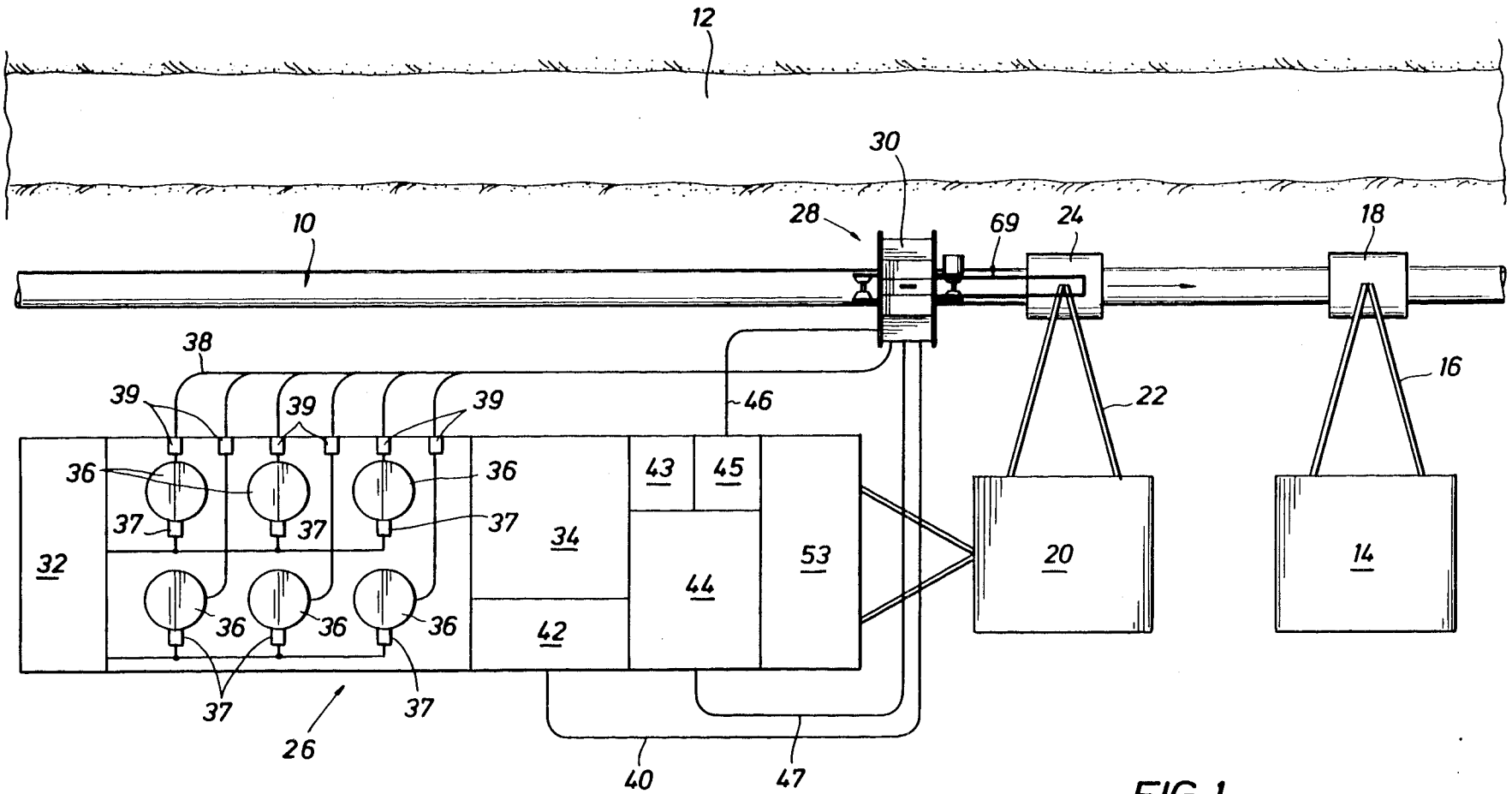
FIG. 1 is a schematic of the apparatus of the present invention for cleaning the outside of pipe including a self propelled carriage riding along the pipe and having nozzles for discharging abrasive particles against the outside of the pipe to clean the pipe and provide a rough finish for the application of a coating.

Referring now to the drawings for a better understanding of this invention and more particularly to FIG. 1, apparatus for cleaning a pipe in accordance with the method of the invention is illustrated. The pipe or pipeline is shown generally at 10 for cleaning and application of a coating or wrap material having an inner coating thereon. Pipe 1 is supported above the ground for being cleaned and coated. Thereafter pipe 10 is placed within a ditch 12 alongside the pipe and covered with soil or gravel.

For supporting the pipeline 10 above the ground, a front side boom tractor shown at 14 has a side boom 16 supporting a roller pipe support 18 mounted under pipe 10 and has rollers thereon for supporting the lower surface of pipe 10. A rear side boom tractor is shown at 20 having a side boom 22 and a roller pipe support 24 about pipe 10 for supporting the pipe.

Rear tractor 20 pulls a trailer or skid indicated generally at 26 alongside pipe 10 which contains the supplies and power sources for operating a self propelled carriage shown generally at 28 mounted on pipe 10 behind roller support 24. Self propelled carriage 28 includes a housing 30 forming an enclosed blasting chamber about pipe 10 for the discharge of abrasive particles against the outside of pipe 10 for cleaning and providing a rough outer finish to pipe 10 for the application of a coating.

Skid 26 includes an air compressor 32, a grit storage bin 34, a plurality of grit pots or containers 36 each having a discharge line 38 for supplying grit entrained in air to housing 30. A hand operated control valve 37 is provided between air compressor 32 and each grip pot 36. An air operated valve 39 is provided in each line 38 adjacent the associated grit pot 36 for control of the supply of grit or abrasive particles to housing 30.

The abrasive particles and removed foreign matter such as rust scales and the like are returned from housing 30 through return line 40 to a cleaner 42 for removal of the foreign matter and return of the abrasive particles to supply bin 34 for recycling. An opening 33 is provided in the bottom of housing 30 leading to line 40. A hydraulic reservoir is shown at 44 on skid 26 and a hydraulic pump 45 supplies pressurized hydraulic fluid through line 46 to self propelled carriage 28. A suitable diesel engine 43 may be provided by for driving hydraulic pump 45. A hydraulic fluid return line 47 is shown for return of fluid to reservoir 44. Skid 26 also includes a control area at 53 for an operator to control the operation including the control of air operated valves 39 and the energizing of hydraulic pump 45.

Figure 5:
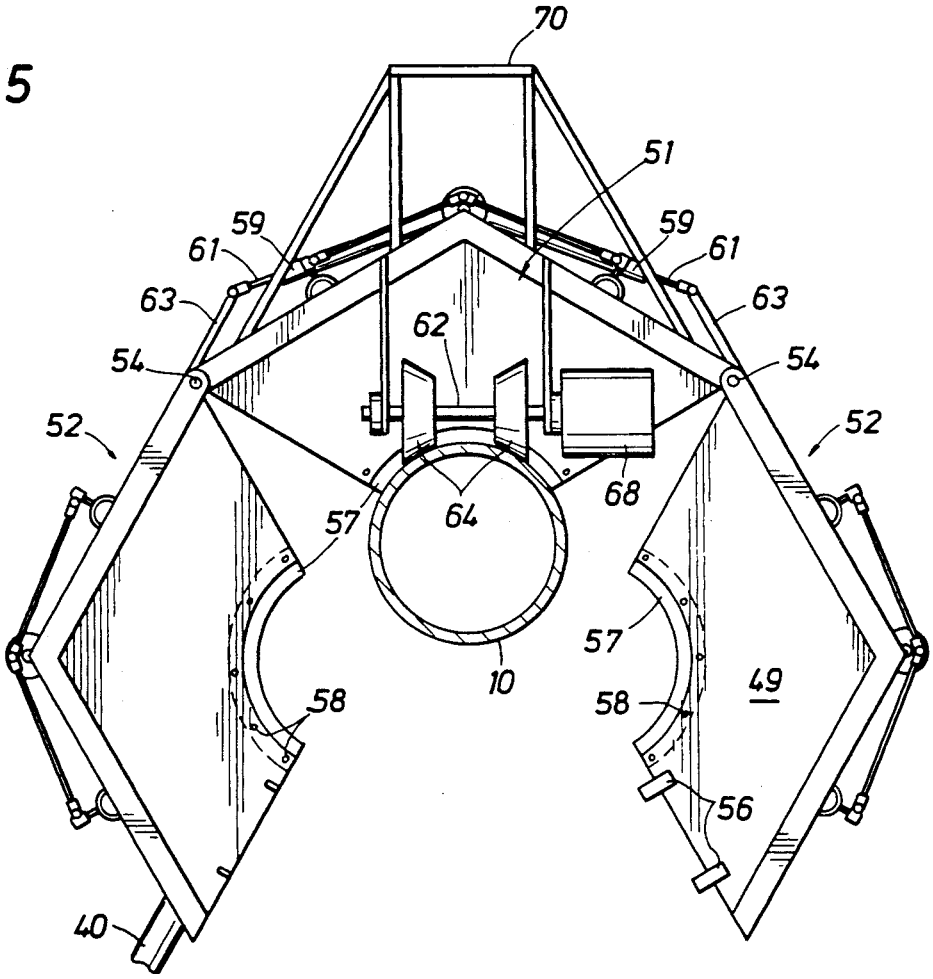
FIG. 5 is an end elevation of the carriage showing the side sections of the carriage housing pivoted outwardly to an open position for placing on and removing from the pipe.

Now, referring to FIGS. 2–6, self propelled carriage 28 forming the present invention is illustrated. Housing 30 is of a generally symmetrical hexagonal shape having six connected sides 48 forming a peripheral wall and a pair of ends 49 secured between sides 48 to form a box-like housing 30 for the blast chamber. Openings 50 in ends 49 receive pipe 10. Housing 30 includes an upper body section 51 having the upper two sides 48 and two opposed side sections 52 hinged at 54 to upper section 50 for relative swinging movement with each side section 52 including a pair of sides 48. As shown in FIG. 5, side sections 52 are in an open "clamshell" like open position for lowering onto pipe 10 while supported from lifting lugs 55 on upper body section 51 or for removing of carriage 28 from pipe 10. A pair of releasable latches shown at 56 are provided on each end 49 for releasably mounting housing 30 about pipe 10. It is noted that each end 49 includes three separate segments as shown particularly in FIG. 5. Each end segment has a resilient seal 57 extending inwardly therefrom and received in lapping relation to its associated end segment by fasteners 58. Seals 57 engage pipe 10 about openings 50 to provide a resilient contact surface with pipe 10.

Figure 2:
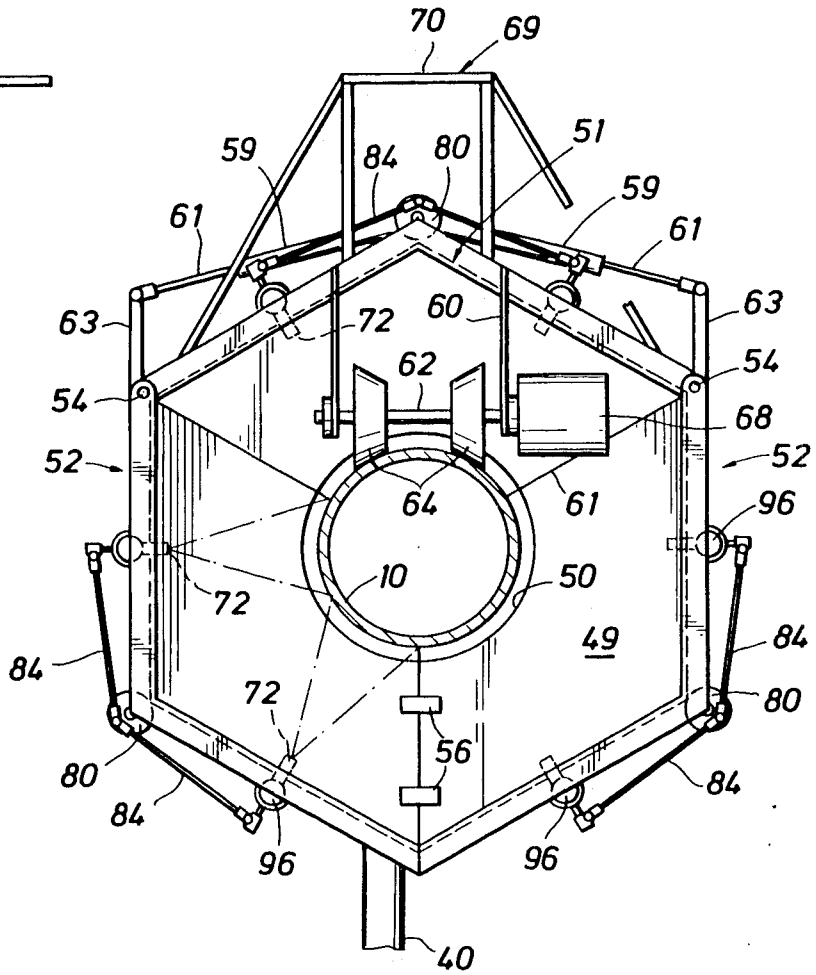
FIG. 2 is an end elevation, partly schematic, of the self propelled carriage shown in FIG. 1 mounted on the pipe and showing abrasive particles discharge lines leading to nozzles spaced about the outer circumference of the pipe for cleaning the pipe.
Figure 3:
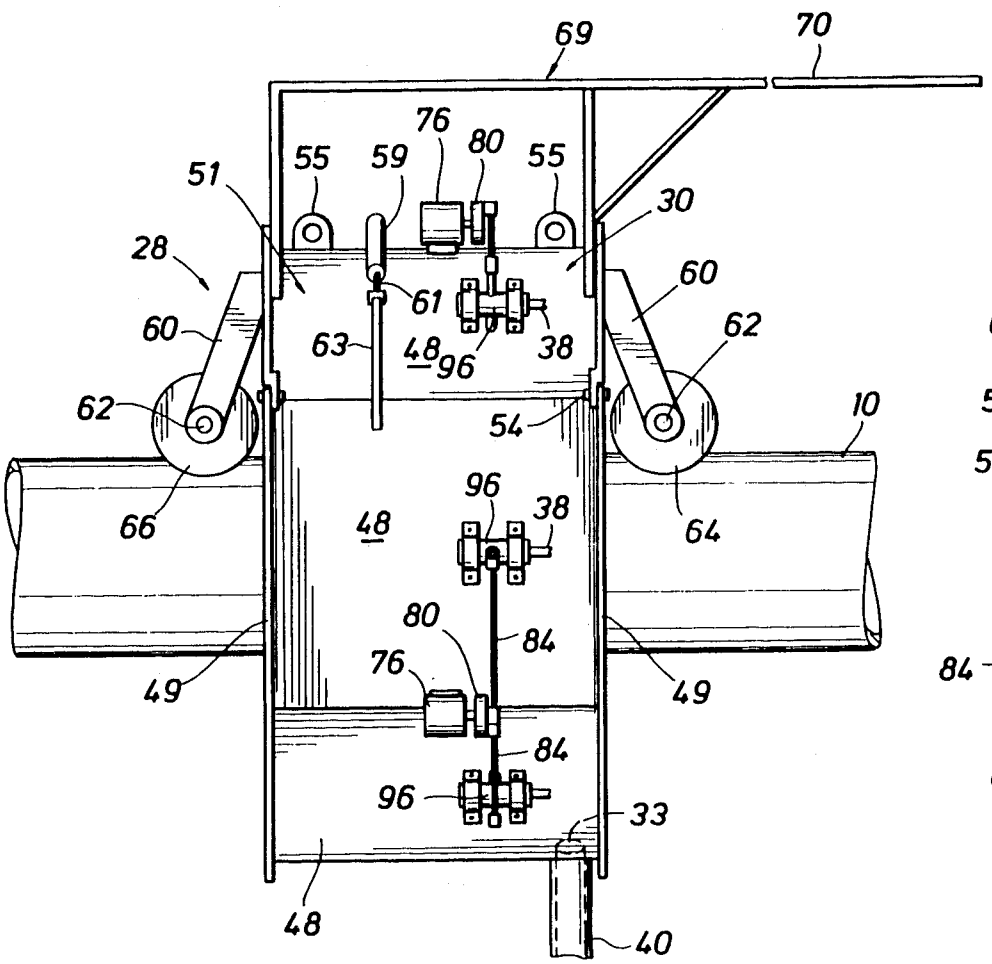
FIG. 3 is a side elevation, partly schematic, of the self propelled carriage of FIG. 2 showing the positioning of nozzle and means for oscillating the nozzles in a predetermined stroke.
Figure 4:
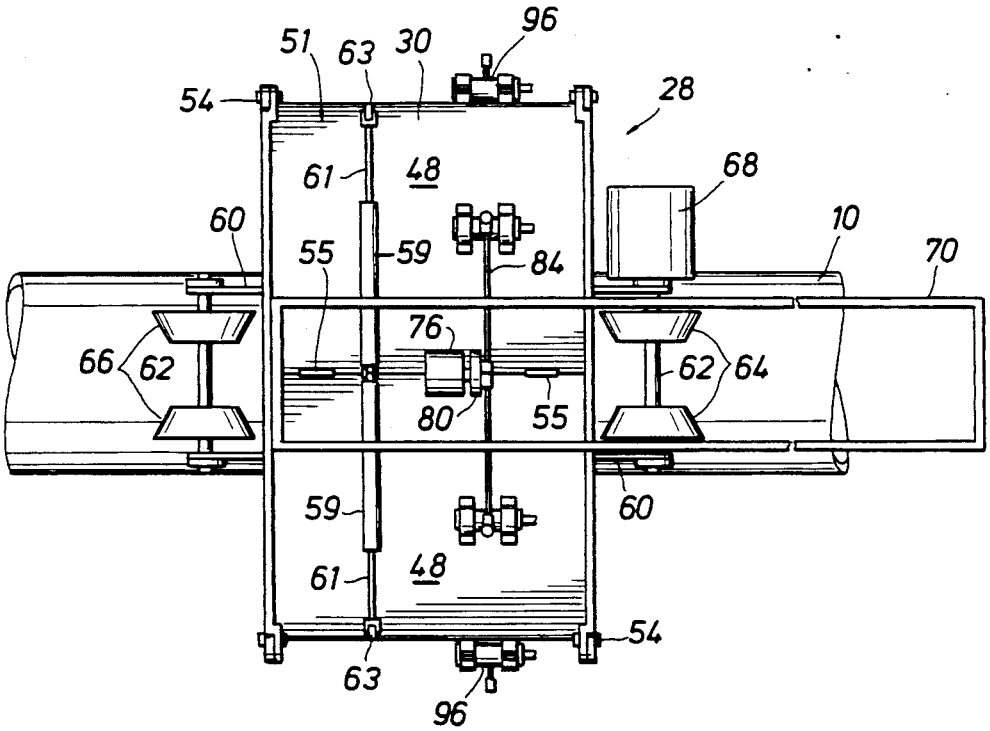
FIG. 4 is a top plan view of the carriage shown in FIGS. and 3 and showing the tubular frame secured to the carriage an extending forwardly thereof.

Suitable fluid operated cylinders 59 are mounted on upper sides 48 of body section 51 and have piston rods 61 connected to an extending plate 63 on side sections 52 as shown in FIG. 2 for movement of side sections 52 between open position and closed position. Hydraulic fluid is supplied from pump 45.

For supporting carriage 28 on pipe 10 brackets 60 are mounted on ends 49 of housing 30 and support shafts 62 thereon. A pair of drive rollers 64 are mounted on drive shaft 62 of front or leading bracket 60 and a pair of idler rollers are mounted on shaft 62 of rear or trailing bracket 60. A hydraulic fluid motor 68 is connected to drive shaft 62 for drive rollers 64 and includes a suitable gear reduction unit. Hydraulic fluid is supplied through a hydraulic line 46 from pump 45 to drive rollers 66 for propelling carriage 28 along pipe 10. Under certain conditions, it may be desirable to drive rear rollers 66 instead of front rollers 64.

Secured to upper section 51 of housing 30 is a tubular frame generally indicated at 69 and including tubular members connected to each other to provide tubular framework. An extending portion 70 of frame 69 extends forwardly of housing 30 over roller pipe support 18 and adjacent side boom 16. Cable from side boom 16 supporting roller pipe support 18 extends through the framework of extension 70 and will contract frame 69 to control the position of housing 30 in the event the speed of carriage 28 and tractor 20 is not identical so that the movement of carriage 28 is positioned properly relative to roller pipe support 24.

For the cleaning of pipe 10, a grit discharge nozzle shown at 72 is mounted on each of the six sides 48 of housing 30 and extends through an elongated opening 74 of each side within the blast chamber formed by housing 30. As shown particularly in FIGS. 6–8, drive means are provided for oscillating each pair of adjacent nozzles 72 including a hydraulic motor 76 mounted on a support 78 secured an adjacent side 48 and supplied with pressurized hydraulic fluid from hydraulic pump 45 and line 46. Hydraulic fluid is returned through line 47 to reservoir 44. Motor 76 has a plate 80 connected to shaft 82 for rotation. Adjustable connecting rods 84 are eccentrically connected at one end by pivot 86 to plate 80. The other end of connecting rods 84 is connected by a pivot 88 to a sleeve or collar 90 mounted for adjustable movement by set screws 92 along a rod 94. Rod 94 is secured to a T-pipe section 96 mounted for rotation on bearings 98. One end of section 96 is closed and the other end is connected to air pressurized grit supply line 38 from a grit container 36 on skid 26, grit or a suitable abrasive material is entrained in pressurized air from air compressor 32 for delivery to nozzle 72 for discharge against the outer surface o pipe 10 for cleaning including the removal of rust scales and the like Nozzle 72 has an orifice 73 therein of around ½ inch in diameter for example and is formed of a hard carbide material for wear resistance.

Nozzles 72 are spaced from pipe 10 a distance between around twelve (12) inches and eighteen (18) inches depending on such factors as the diameter of pipe 10 and the specification for the desired finish. For example, for pipe sizes between 4–12 inches in diameter, the nozzle is spaced twelve (12) inches, and for pipe sizes between 24–48 inches in diameter, the nozzle is spaced eighteen (18) inches from pipe 10.

It is noted that a separate grit container 36 is provided for each nozzle 72 and the operator in control area 53 controls the operation of hydraulic pump 45 and the supply of grit from grit pots 36. Hydraulic fluid is supplied to the three hydraulic motors 76 for oscillating nozzles 72 through a single supply line 46 which is connected in series to motors 76. Hydraulic line 47 returns hydraulic fluid from all the hydraulic motors 68 and 76 to reservoir 44.

The present invention is particularly directed to sand blasting in which sand is projected against a surface to be cleaned by a high pressure air stream from a carriage 28 moving along the pipe. The housing 30 provides a blast chamber about the pipe which is generally air tight except for the elongate openings 74 receiving nozzles 72. If desired, suitable flexible material could be provided to enclose openings 74. The size of the sand particles will vary dependent on such factors as, the desired pipe finish, the coating to be removed, and the coating to be reapplied including the thickness of the coating and the condition of the pipe.

The velocity of the discharged grit at nozzles 72 varies in regard to such factors as the nozzle size, the amount of sand or grit being used, the air pressure at nozzles 72 and the capacity of the air compressor. As an example, utilizing sand and a nozzle having a uniform diameter orifice of ½ inch in diameter, a velocity of around 4,000 feet per second is obtained at a grit consumption rate per nozzle of fifteen (15) cubic feet per hour and a pressure at the nozzle of around one hundred (100) psi. While six nozzles 72 have been shown in the drawings, it is to be understood that fewer or additional nozzles may be utilized as desired dependent primarily on the pipe diameter. Further, while separate drive means for oscillating a pair of nozzles has been shown, it is understood that each nozzle may have separate drive means or all nozzles may be oscillated from a single drive means, if desired.

In operation, self propelled carriage 28 is lifted by lugs 55 by a side boom tractor over pipe 10 with hydraulic cylinders 59 extended to hold side sections 49 in an open "clamshell" like positions. Carriage 28 is lowered onto pipe 10 with drive wheels 64 and idler wheels 66 contacting and supported on the upper surface of pipe 10. Then, cylinders 59 are actuated by the operator to close side sections 49 about pipe 10 and latches 56 on side sections 49 are then latched. Pipe 10 has been previously lifted from the ground by roller pipe supports 18 and 24 ahead of the self propelled carriage 28. Next, the operator supplies hydraulic fluid to hydraulic motor 76 for oscillating nozzles 72. Then, air operated valves 39 are opened by the operator to supply grit in high pressure air streams in lines 38 to nozzles 72 at a pressure of around 100 psi. In such manner a rate of speed along pipe 10 for self propelled carriage 28 of around 950 feet per hour should be provided for a thirty (30) inch diameter pipe. After blasting of pipe 10 the grit along with rust scales, dirt, paint, coating particles and the like fall to the bottom of housing 30 for return through opening 33 and vacuum line 40 to the grit cleaner 42 for cleaning of the grit as well known in the art. The cleaned grit is returned to grit storage 34 for supply of grit to grit pots 36 for another cycle.

It is understood that other types of movement may be provided to nozzles 72 in order for nozzle 72 to cover the desired outer surface area of pipe while utilizing a generally uniform diameter orifice. As shown in FIG. 9, a modification of the present invention is shown to add a circular movement to the oscillating movement of the nozzles. Nozzle 72A extends within opening 74A of side 48A and grit is supplied through line 38A and T-connection 96A to nozzle 72A for discharge through orifice 73A. A ball 104 is secured to nozzle 72A and mounted for movement within bearing sleeve 98A secured to side 48A. An externally threaded rod 94A is secured to T-fitting 96A. Connecting arm 84A has a ball joint 106 on one end thereof eccentrically mounted o drive plate 80A which is driven by fluid motor 76A. A ball joint 108 on the other end of connecting arm 84A is connected to threaded rod 94A and a ball joint 110 mounted on opposed adjustable nuts 112 is connected to arm 84A intermediate ball joints 106 and 108. The oscillating stroke of nozzle 72A may be adjusted by adjustment of ball joint 108 along threaded rod 94A by adjustment of spaced nuts 112 thereon. Upon rotation of plate 80A ball 108 of connecting rod 84A moves in a direction to provide an oscillating generally circular motion.

As preferred embodiments of the present invention have been illustrated, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A method for cleaning the outside of a pipe from a self propelled carriage supported on the upper surface of the pipe for movement along the pipe and a skid pulled alongside the pipe by a prime mover; said method comprising the following steps:

providing an enclosed housing for the carriage having a pair of opposed side sections on opposite sides of the pipe hinged for swinging movement to an open position from a center body section and spaced from the pipe to permit the housing to be lowered onto the pipe;

providing rollers on said housing for contacting the outer surface of the pipe to support the carriage for movement along the pipe;

lowering the housing onto the pipe with said side sections in an open position and said center body section contacting the upper surface of the pipe;

swinging said side sections to a closed position about said pipe and releasably securing said side sections in closed position about said pipe;

mounting a plurality of nozzles on the housing at spaced arcuate intervals about the pipe with the lower ends of said nozzles extending within a blast chamber formed by said housing about said pipe;

supplying abrasive particles from the skid to said nozzles in a pressurized stream of air from the skid; and mounting fluid motors on the outer surface of said enclosed housing operatively connected to said nozzles for oscillating said nozzles in a predetermined stroke for cleaning a predetermined outer surface area of the pipe as the carriage moves along the pipe.

2. A method of positioning a self propelled carriage about a pipe and cleaning the exterior surface of the pipe by pressurized cleaning material; said method comprising the following steps;

providing a housing for said carriage having a center body section and a pair of opposed side sections hinged to the body section for relative swinging movement.

providing rollers on said housing for contacting the outer surface of the pipe to support the carriage thereon and mounting said side sections on said center section for pivotal movement relative to said center section;

providing drive means for at least one of said rollers for propelling said carriage along the pipe;

moving said side sections to an open position in which the side sections are swung outwardly in a "clamshell" like pattern;

lowering said housing with said side sections in an open position onto the pipe with the center body section contacting the upper surface of the pipe in supporting relation;

then moving said side sections to a closed position about said pipe to provide an enclosed cleaning chamber about the pipe;

releasably securing said side sections in closed position about said pipe;

mounting a plurality of nozzles on the housing at spaced arcuate intervals about the pipe with the inner discharge ends of said nozzles being within said chamber;

supplying pressurized cleaning material to said nozzles for discharge in a high velocity stream against said pipe; and mounting drive motors on the outer surface of said housing operatively connected to the nozzles for oscillating said nozzles in a predetermined stroke for cleaning the entire outer surface of the pipe.

3. A method of positioning a carriage on a pipe and cleaning the outside of the pipe from the carriage as the carriage moves along the pipe; said method comprising the following steps:

providing an upper support section having spaced front and rear rollers for contacting the upper surface of the pipe to support the carriage thereon.

providing an enclosed housing for the carriage between said front and rear rollers of said upper support section including a pair of opposed side sections supported from said upper support section between said front and rear rollers for swinging movement to an open position and spaced from the pipe to permit the carriage to be lowered onto the pipe;

lowering the carriage onto the pipe with said side sections in an open position and said front and rear rollers on said upper support section contacting the upper surface of the pipe;

swinging said side sections to a closed position about said pipe for providing said enclosed housing about the pipe between said front and rear rollers and releasably securing said side sections in closed position about said pipe;

mounting a plurality of nozzles of the housing at spaced arcuate intervals about the pipe with the lower ends of said nozzles extending within a cleaning chamber formed by said housing about said pipe;

supplying pressurized cleaning material to said nozzles in a high velocity pressurized stream for discharge against said pipe; and mounting drive means on the outer surface of said housing operatively connected to said nozzles for oscillating said nozzles in a predetermined stroke for cleaning a predetermined outer surface area of the pipe as the carriage moves along the pipe.

4. The method as set forth in claim 3further including the following steps for removal of the carriage from the pipe after the cleaning operation:

releasing said side sections from closed position about said pipe between said front and rear rollers of said upper support section;

swinging said side sections to an open position relative to said upper support section; and lifting of said carriage from said pipe by lifting of said upper support section with said side sections supported therefrom in an open position.

5. A method of positioning a carriage on a pipe and cleaning the outside of the pipe from the carriage as the carriage moves along the pipe; said method comprising the following steps:

providing an upper support section having spaced front and rear rollers for contacting the upper surface of the pipe to support the carriage thereof;

providing an enclosed housing for the carriage between said front and rear rollers of said upper support section including a pair of opposed side sections supported from said upper support section for swinging movement to an open position and spaced from the pipe to permit the carriage to be lowered onto the pipe;

lowering the carriage onto the pipe with said side sections in an open position and said front and rear rollers on said upper support section contacting the upper surface of the pipe;

swinging said side sections to a closed position about said pipe and releasably securing said side sections in closed position about said pipe;

mounting a plurality of nozzles on the housing at spaced arcuate intervals about the pipe with the lower ends of said nozzles extending within a cleaning chamber formed by said housing about said pipe;

supplying pressured cleaning material to said nozzles in a high velocity pressurized stream for discharge against said pipe;

mounting drive means on the outer surface of said housing for oscillating said nozzles in a predetermined stroke for cleaning a predetermined outer surface area of the pipe as the carriage moves along the pipe;

providing drive means for at least one of said rollers for propelling said carriage along the pipe; and mounting fluid motor externally of said housing and operatively connecting said fluid motors to said nozzles for oscillating said nozzles in a predetermined stroke.

6. A method of positioning a carriage on a pipe and cleaning the outside of the pipe from the carriage as the carriage moves along the pipe; said method comprising the following steps:

providing an upper support section having spaced front and rear rollers for contacting the upper surface of the pipe to support the carriage thereon;

providing an enclosed housing for the carriage between said front and rear rollers of said upper support section including a pair of opposed side sections supported from said upper support section for swinging movement to an open position and spaced from the pipe to permit the carriage to be lowered onto the pipe;

providing drive means for at least one of said rollers for propelling said carriage along the pipe;

lowering the carriage onto the pipe with said side section in an open position and said front and rear rollers on said upper support section contacting the upper surface of the pipe;

swinging said side sections to a closed position about said pipe and releasably securing said side sections in closed position about said pipe;

mounting a plurality of nozzles on the housing at spaced arcuate intervals about the pipe with the lower ends of said nozzles extending within a cleaning chamber formed by said housing about said pipe;

supplying pressurized cleaning material to said nozzles in a high velocity pressurized stream for discharge against said pipe; and mounting hydraulic fluid motors on the outer surface of said housing operatively connected to said nozzles for oscillating said nozzles in a predetermined stroke for cleaning a predetermined outer surface area of the pipe as the carriage moves along the pipe.

* * * * *